US006244160B1

(12) United States Patent
Kunze

(10) Patent No.: US 6,244,160 B1
(45) Date of Patent: Jun. 12, 2001

(54) AXIAL PISTON MACHINE WITH RMP-DEPENDENT PRESSURE ACTING AGAINST THE CYLINDER DRUM

(75) Inventor: Thomas Kunze, Roggenburg (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/355,480

(22) PCT Filed: Feb. 2, 1998

(86) PCT No.: PCT/EP98/00550

§ 371 Date: Jul. 30, 1999

§ 102(e) Date: Jul. 30, 1999

(87) PCT Pub. No.: WO98/37308

PCT Pub. Date: Aug. 27, 1998

(30) Foreign Application Priority Data

Feb. 18, 1997 (DE) ..... 197 06 263

(51) Int. Cl.[7] ..... F01B 13/04

(52) U.S. Cl. ..... 92/57; 417/269; 91/499

(58) Field of Search ..... 417/269; 91/499; 92/57, 71

(56) References Cited

U.S. PATENT DOCUMENTS

| | | | | |
|---|---|---|---|---|
| 3,618,471 | * | 11/1971 | Hein et al. | 91/485 |
| 3,657,970 | * | 4/1972 | Kobayashi et al. | 91/485 |
| 3,802,321 | * | 4/1974 | Bosch | 91/485 |
| 3,810,715 | * | 5/1974 | Week et al. | 417/213 |
| 4,014,250 | * | 3/1977 | Bosch | 91/487 |
| 5,826,488 | * | 10/1998 | Arai et al. | 92/12.2 |

FOREIGN PATENT DOCUMENTS

| | | |
|---|---|---|
| 1 226 418 | 4/1967 | (DE) . |
| 2446535 * | 4/1976 | (DE) . |
| 24 46 535 A1 | 4/1976 | (DE) . |
| 44 05 034 A1 | 8/1995 | (DE) . |
| 195 22 168 A1 | 1/1997 | (DE) . |
| 0 162 238 B1 | 3/1985 | (EP) . |
| 2 075 622 | 10/1971 | (FR) . |

* cited by examiner

*Primary Examiner*—Charles G. Freay
(74) *Attorney, Agent, or Firm*—Scully, Scott, Murphy & Presser

(57) ABSTRACT

The invention relates to an axial piston machine (1) comprising a housing (50), a drive shaft (3) mounted in a rotational manner in the housing (50) around a drive shaft axis (12), a cylinder drum (2) which is connected to the drive shaft (3) in a non-rotational manner and in which are embodied cylinders (4) for receiving axially movable pistons (6), and a control plate (26) with control openings (24, 25) designed to cyclically connect the cylinders (5) with a high-pressure and a low-pressure line. The invention provides for a pressing device with at least one centrifugal body (30*a*–30*f*), which is impinged upon by a centrifugal force ($F_F$) that increases with the number of rotations per minute (n) of the cylinder drum (2). The invention also provides for a force deflection unit (36–39; 40*a*–40*f*, 41*a*–41*f*) designed to transform the centrifugal force ($F_F$) acting on the centrifugal body (30*a*–30*f*) into a force acting against the cylinder drum (2), whereby said force has a component ($F_A$) which is aligned towards the control plate (26) and in an axial position in relation to the drive shaft axis (12).

14 Claims, 5 Drawing Sheets

1
2
3
4
5
6
7
8
9
10
11
12
13
14
15
16
17
18
19
20
21
22
23
24
25
26
30a
30d
31
33
34
40a
40d
41a
41d
42
β

1
2
3
4
5
6
7
8
9
10
11
12
13
14
15
16
17
18
19
20
21
22
23
24
25
26
30a
30d
32
33
34
34a
36
37
38
39
50
51
52
60d
61
62d
63d
β

AXIAL PISTON MACHINE WITH RMP-DEPENDENT PRESSURE ACTING AGAINST THE CYLINDER DRUM

CROSS-REFERENCE TO RELATED APPLICATION

This is a 371 application of PCT/EP 98/00550, filed on Feb. 2, 1998.

BACKGROUND OF THE INVENTION

1. Field of the Invention

2. Discussion of the Prior Art

The invention relates to an axial piston machine with RPM-dependent pressure acting against a cylinder down of the machine.

An axial piston machine according to the current state-of-the-art is known from DE 195 22 168 A1, for example. The axial piston machine disclosed in the latter consists of a drive shaft, which is mounted in a casing so as to rotate about a drive shaft axis, a cylinder barrel, which is non-rotatably connected to the drive shaft and in which cylinders are formed to accommodate axially mobile pistons, and a control plate with control ports for cyclically connecting the cylinders to a high- and a low-pressure line. Also provided is a contact pressure device for pressing the cylinder barrel against the control plate and thus preloading it against the control plate. This preloading of the rotating cylinder barrel with respect to the stationary control plate is required in order to guarantee a tight seal between the cylinder barrel and the control plate and counteract any lifting of the cylinder barrel off the control plate at high speeds. A particular requirement is to exclude the possibility of the cylinder barrel running off-center at high speeds.

The contact pressure device known from DE 195 22 168 A1 consists substantially of a contact pressure spring which is provided in the cavity between the drive shaft and the cylinder barrel and is supported at one end at the drive shaft and at the other end at the cylinder barrel, so that the cylinder barrel is preloaded with respect to the connecting block, at which the drive shaft is mounted and in which the control ports are provided. However the contact pressure spring exerts a constant contact pressure force, which is independent of the speed, on the cylinder barrel. This is detrimental insofar as the contact pressure force required is predetermined by the inertia forces which are exerted by the pistons and which increase with the square of the cylinder barrel operating speed. The contact pressure force which is exerted by the contact pressure spring must therefore be defined for the maximum cylinder barrel speed and its magnitude calculated accordingly. However this inevitably results in the contact pressure force which is exerted by the contact pressure spring operating in the same way at low speeds as well. This leads to mechanical friction losses and increased wear of the sliding partners consisting of the cylinder barrel and the control plate. An increase in the maximum operating speed must be accompanied by an increase in the spring preload exerted by the contact pressure spring, which is only possible within certain limits.

EP 0 162 238 B1, in view of the foregoing therefore proposes distributing hydraulic auxiliary cylinders over the circumference of the cylinder barrel, the working spaces of which cylinders are connected to the cylinder bores in the main cylinders. A cylinder barrel contact pressure which is dependent on the working pressure and thus the speed is achieved by means of the auxiliary cylinder. However this solution has the disadvantage of a relatively high expenditure for forming the additional hydraulic cylinders, which leads to relatively high manufacturing costs. The construction space required for the axial piston machine is also increased.

A further proposal, according to DE 195 22 168 A1, lies in providing a throttled connection between the overflow space of the casing and the overflow oil drain line in order that an additional contact pressure can be increased with the speed. The back pressure arising as a result in the overflow oil space of the axial piston machine produces an additional small axial force component by means of which the cylinder barrel is pushed in the direction of the connecting block. However this additional force component is comparatively small, as the casing wall of a conventional axial piston machine only resists a relatively low internal pressure. There is also the problem of churning losses or turbulence losses occurring at high overflow oil levels when the drive mechanism enters the overflow oil.

An additional publication to be mentioned is DE-OS 24 46 535, from which it is known to use a centrifugal force device to act on the holding-down appliance to press the slide shoes onto the oblique plate. For this purpose centrifugal weights are disposed at the circumference of the cylinder barrel and act on the pull-back ball of the holding-down appliance via a linkage and a contact pressure plate. However this centrifugal force appliance only serves to press the slide shoes against the oblique plate of the axial piston machine, which requires substantially smaller forces when compared with those required for pressing the cylinder barrel against the control plate. Moreover, the centrifugal force appliance is of a relatively low efficiency, as the linkage passing through the cylinder barrel is inclined in the radial direction and only a relatively small axial force component is therefore transmitted to the holding-down appliance. The additional construction elements in the form of the linkage and the contact pressure plate make the construction relatively complex and cost-intensive. A further undesirable feature is the increased construction space of the axial piston machine due to the arrangement of the centrifugal weights at the outer diameter. Moreover, the play in the centrifugal weight assembly is not compensated by the surrounding auxiliary or pressure elements. There is thus no guarantee that the centrifugal weights will bear against the support or pressure elements and therefore act on the appliance at relatively low speeds and when accelerating from a standstill. The result is inadequate slide shoe contact pressure in the low speed range.

It is known from DE-PS 1 226 418 to provide a centrifugal force appliance provided with a lever arm and likewise comprising centrifugal weights at the outer diameter of the cylinder barrel to press the slide shoes against the oblique plate. This appliance also has a very complex system for introducing forces. The force ranges available for pressing the cylinder barrel against the control plate in accordance with the speed are entirely different from those in the case of holding-down appliances which serve to press the slide shoes onto the oblique plate. The centrifugal force appliances known from the above publications are therefore in no way suitable for solving the problem on which the invention is based.

SUMMARY OF THE INVENTION

The object of the invention is to present an axial piston machine with a contact pressure device for pressing the cylinder barrel against the control plate in which an unnecessarily high contact pressure in the low speed range is prevented and which is of a simple construction.

The invention is based on the recognition that a contact pressure device with a speed-dependent contact pressure force for pressing the cylinder barrel against the control plate can be formed in a simple manner by using centrifugal bodies which, via a force redirection device, convert the centrifugal force into a contact pressure force which acts on the cylinder barrel and has a force component which is directed at the control plate and axial in relation to the drive shaft axis. This prevents an unnecessarily high contact pressure force in the low speed range and minimises friction losses. A further advantage lies in the low wear levels at the sealing and sliding points. In contrast to the contact pressure resulting from a constant spring force, the maximum speed is not limited by the contact pressure device, as the contact pressure force continuously increases with the speed.

According to the invention, the force redirection device may be supported at the drive shaft and optionally disposed together with the centrifugal bodies in a cavity between the cylinder barrel and the drive shaft, which results in a particularly compact design. According to another aspect, however, it is also possible for the force redirection device to be supported at the casing of the axial piston machine.

According to a further feature, an oblique surface may be provided at the centrifugal body or a caulking element connected to the centrifugal body, the normal to which oblique surface is inclined with respect to the drive shaft axis by a predetermined angle of inclination. According to the invention, the oblique surface may also be provided in a corresponding manner with a counterpart which is functionally connected to the centrifugal body or the caulking element. The centrifugal force directed in the radial direction is converted into an axial force component by the wedge effect occurring due to the angle of inclination of the oblique surface. According to another feature, the angle of inclination which the normal to the oblique surface forms with the drive shaft axis preferably lies in the range between 5° and 25°. A preferred value is 15°.

According to still another feature, the caulking element can be integrated into the cavity between the cylinder barrel and the drive shaft and connected to the centrifugal body via a radial connecting element. The centrifugal body may in this case be disposed at the outer circumference of the cylinder barrel, so that a particularly high centrifugal force acts on the centrifugal body on account of the large radial distance from the drive shaft axis. The centrifugal body may then also be integrated within the cylinder barrel and, in particular, be radially flush with the cylinder barrel.

The counterpart, with which the centrifugal body or the caulking element connected to the latter co-operates, may consist of two support rings, with a first support ring being supported at the drive shaft, according to the invention, and a second support ring being supported at the cylinder barrel. According to yet another feature, at least one of the support rings may be preloaded in a particularly advantageous manner against the centrifugal body or the caulking element by means of a spring element, e.g. a Belleville spring. The centrifugal body or the caulking element thus bears without play against the support rings, which act as a counterpart, so that the contact pressure force, which depends on the centrifugal force, according to the invention is also active in the low speed range and when accelerating from a standstill.

According to the invention, the centrifugal body may be mounted on one side at the cylinder barrel, and a projection of the centrifugal body may act on a shoulder of the drive shaft such that the axial force component of the contact pressure force is exerted on the cylinder barrel due to the lever action which is initiated. It is conversely also possible, according to invention aspect, to mount the centrifugal body on the drive shaft instead of on the cylinder barrel.

The centrifugal force appliance according to the invention may also simultaneously be used to achieve a speed-dependent increase in the contact pressure force of the holding-down appliance for pressing the slide shoes against the oblique plate.

This measure ensures that there is no possibility of the slide shoes lifting off the slide surface of the oblique plate even at high speeds. According to inventive features, the contact pressure force for the holding-down appliance may in particular be transmitted through a connecting member, in particular an axially oriented connecting pin, disposed between the pull-back ball of the holding-down appliance and the force redirection device, in particular one of the support rings.

BRIEF DESCRIPTION OF THE DRAWINGS

Preferred embodiments of the invention are described in detail in the following with reference to the drawings, in which.

DETAILED DESCRIPTION OF PREFERRED EMBODIMENT

Figure 1:
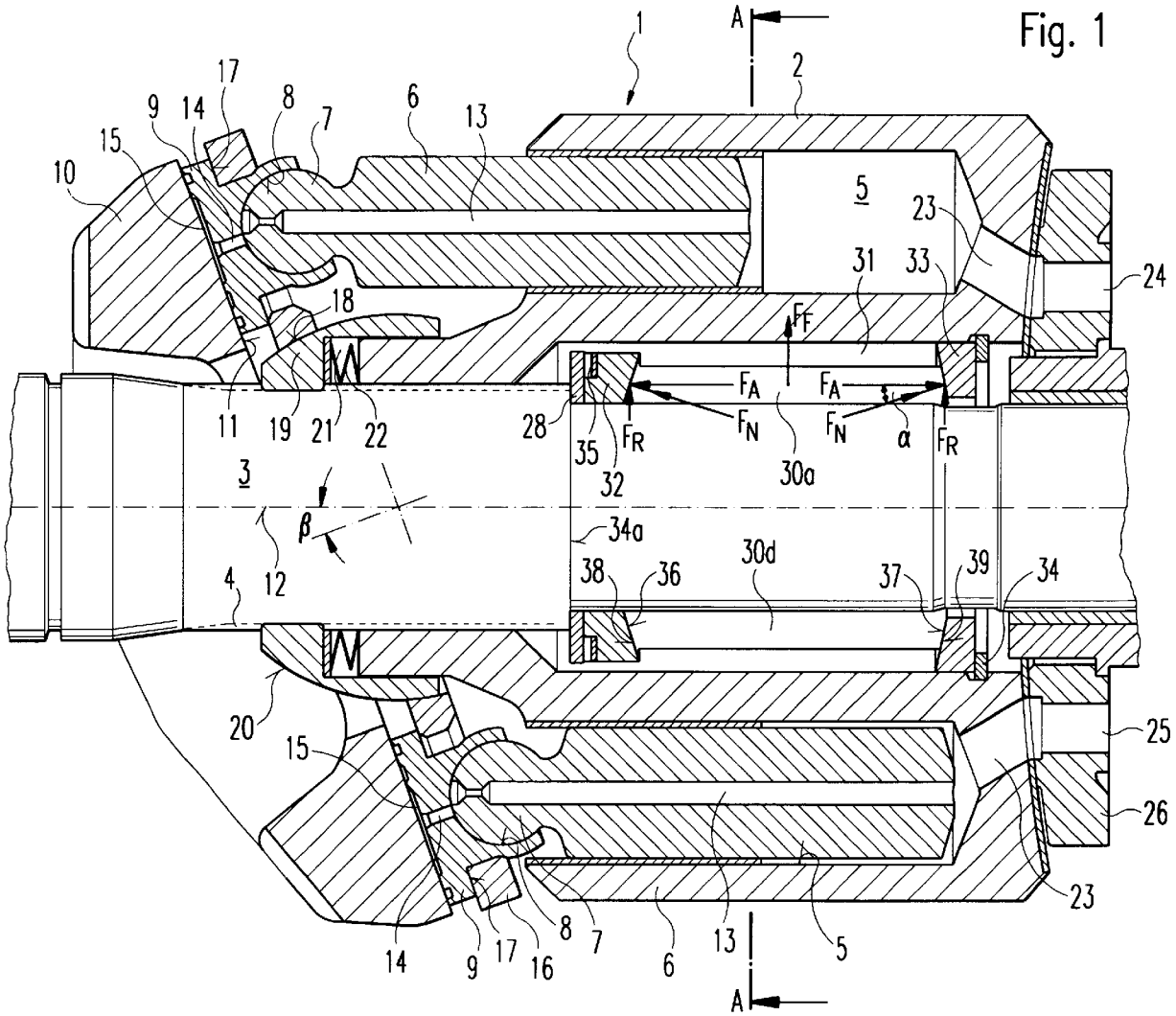
FIG. 1 is an axial section through a first embodiment of an axial piston machine according to the invention.

FIG. 1 is an axial section through a first embodiment of an axial piston machine developed according to the invention. The axial piston machine, which is only shown in part, comprises a drive shaft 3, to which a cylinder barrel 2 is connected in a non-rotatable, yet axially displaceable manner by means of a keyed joint 4. The cylinder barrel 2 comprises cylinder bores 5 which are evenly distributed radially over a common circumferential circle and in which pistons 6 are guided in an axially displaceable manner. The pistons 6 each comprise a ball head 7, which is pivotably mounted in a spherical recess 8 in the associated slide shoe 9. The pistons 6 are supported via the slide shoes 9 against a non-rotating oblique plate 10, with the piston stroke being determined by the pivot angle β which the normal to the slide surface 11 of the oblique plate 10 forms with the drive shaft axis 12. The pistons comprise an axial longitudinal bore 13, which is connected to a pressure pocket 15 at the slide shoe sole via a bore 14 formed in the slide shoes 9 for relieving the latter of hydrostatic pressure. The slide shoes are guided in an annular pull-back plate 16, which in each case bears against a shoulder-like locating surface 17 of the slide shoes 15. A partially spherical pull-back ball 19 is inserted in a central bore 18 in the pull-back plate 16, which ball is connected to the pull-back plate 16 at a spherical outer surface 20 whatever the pivot angle β of the oblique plate 10.

The holding-down appliance 16, 19, which consists of the pull-back plate 16 and the pull-back ball 19, is urged by one or more spring(s) 22, which is/are inserted in a recess 21 in the pull-back ball, in the axial direction against the oblique plate 10, so that the slide shoes 9 constantly bear on the slide surface 11 of the oblique plate 10 and do not lift off the slide surface 11, in particular when a suction stroke is executed.

The cylinder bores 9 are connected via connecting channels to kidney-shaped control ports 24 and 25, which are formed in the control plate 26, in order to cyclically connect the cylinder bores 5 to a high- and a low-pressure line, which are not represented, each time the cylinder barrel 2 rotates.

The development according to the invention relates to an improvement in the contact pressure of the cylinder barrel 2 against the control plate 26. One or more, in the embodiment six, radially distributed centrifugal body/bodies 30*a* to 30*f* is/are provided according to the invention. The centrifugal bodies 30*a* to 30*f* are located within an annular cavity 31 formed between the cylinder barrel 2 and the drive shaft 3 in the first embodiment represented in FIG. 1. The centrifugal bodies 30*a* to 30*f* are clamped between two support rings 32 and 33 acting as counterparts. The first support ring 32 is supported via a locating ring 28 at a shoulder 34 of the drive shaft 3. The second support ring 33 is supported via a further locating ring 34 at the cylinder barrel 2. At least one of the support rings, this being the support ring 32 in the embodiment represented in FIG. 1, is preferably resiliently supported in the axial direction by means of a spring element 35, e.g. a Belleville spring, so that any assembly play between the centrifugal bodies 30*a* to 30*f* and the support rings 32 and 33 is compensated and the centrifugal bodies 30*a* to 30*f* also bear against the support rings 32 and 33 at low speeds and in a state of standstill.

Figure 2:
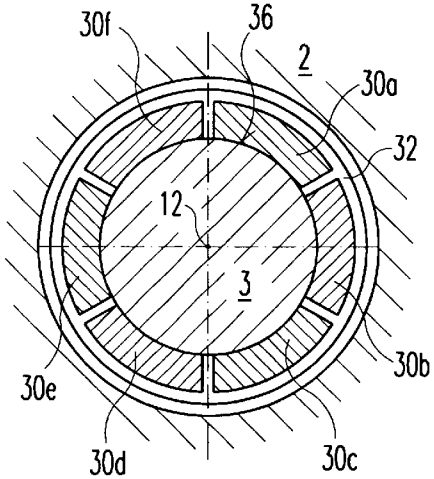
FIG. 2 is a section along the line A—A in FIG. 1.

FIG. 2 is a section, in the form of a partial view, along the line A—A in FIG. 1, which is intended to provide a better illustration of the arrangement of the centrifugal bodies 30*a* to 30*f*. The centrifugal bodies 30*a* to 30*f* form a ring segment in the embodiment shown in FIGS. 1 and 2. The centrifugal bodies 30*a* to 30*f* may bear against the outer circumference 36 of the drive shaft 3 in the non-operative state. The end surfaces of the centrifugal bodies 30*a* to 30*f* are each formed as oblique surfaces 38 and 39 which narrow outwards conically in the radial direction and which bear flush against corresponding second oblique surfaces 38 and 39 which are formed at the support rings 32 and 33 and which also narrow outwards conically in the radial direction. As the speed of the drive shaft 3 and the cylinder barrel 2 increases, a centrifugal force $F_F$ acts on each of the centrifugal bodies 30*a* to 30*f* and pushes these bodies radially outwards. The centrifugal force $F_N$ is in this case proportional to the square of the speed n of the drive shaft 3 or cylinder barrel 2. A normal force $F_N$ is introduced into the support rings 32 and 33 at the oblique surfaces 38, 39 and 36, 37, respectively, which force is perpendicular to the normals to the oblique surfaces 36, 37 and 38, 39, respectively. The normal force $F_N$ divides into a radial component $F_R$ and an axial component $F_A$ in accordance with the angle of inclination α which the normal to the oblique surfaces 36, 37 and 38, 39, respectively, forms with the drive shaft axis 12. If the centrifugal bodies 30*a* to 30*f* are formed so as to be symmetrical, the radial force components $F_R$ only create internal forces in the support rings 32 and 33. The axial force component $F_A$ results in the desired contact pressure of the cylinder barrel 2 against the control plate 26.

The angle of inclination a which the normal to the oblique surfaces 36, 37 and 38, 39, respectively, forms with the drive shaft axis 12 preferably lies between 5° and 25°. A particularly preferred angle of inclination α is 15°.

The embodiment represented in FIG. 1 has the advantage of a particularly compact construction, as the cavity 31 provided between the cylinder barrel 2 and the drive shaft 3 is used to accommodate the centrifugal force appliance according to the invention.

The oblique surfaces 38, 39 of the centrifugal bodies 30*a* to 30*f* co-operate with the oblique surfaces 36, 37 of the support rings 32 and 33 to form a force redirection device which converts the centrifugal force $F_F$ acting on the centrifugal bodies 30*a* to 30*d* into a contact pressure force acting on the cylinder barrel 2 and having a component $F_A$ which is directed towards the control plate 26 and is axial in relation to the drive shaft axis 12.

Figure 3:
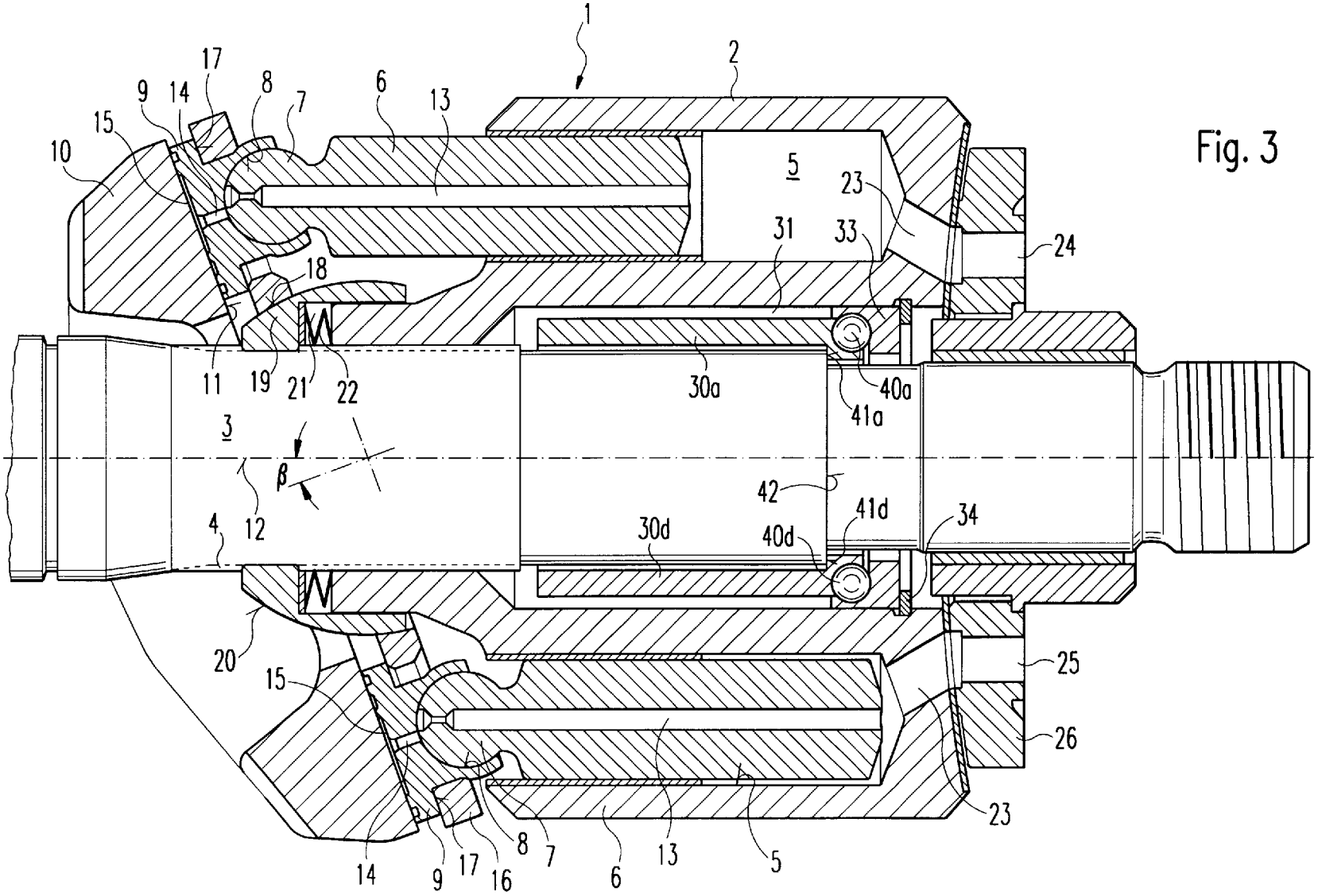
FIG. 3 is an axial section through a second embodiment of an axial piston machine according to the invention.

FIG. 3 is an axial section of an axial piston machine with a second embodiment of the development according to the invention. Elements which have already been described are marked with corresponding reference numbers.

In the embodiment represented in FIG. 3 the centrifugal bodies 30*a* to 30*d* are likewise disposed in the cavity 31 formed between the cylinder barrel 2 and the drive shaft 3 and are formed as segments which complement each other to form a ring. The centrifugal bodies 30*a* to 30*f* are each mounted on one side at one end in a support ring 33 in a centrifugal body mounting 40*a* to 40*f*, which is formed as a ball bearing in the embodiment. The support ring 33 is supported via a locating ring 34 at the cylinder barrel 2 or is secured thereto. Each centrifugal body 30*a* to 30*f* comprises a projection 41*a* to 41*f*, which acts on a step or a shoulder 42 of the drive shaft 3. If the drive shaft 3 and the cylinder barrel 2 are rotated, the centrifugal bodies 30*a* to 30*f* spread out radially by swinging out slightly through small pivot angles in the associated centrifugal body mountings 40*a* to 40*f*. The centrifugal bodies 30*a* to 30*f* push with their projections 41*a* to 41*f* against the shoulder 42 of the drive shaft 3, so that, on account of the lever action which is initiated, the centrifugal body mounting 40*a* to 40*f* is subjected to a force component which acts in the axial direction and is transmitted to the cylinder barrel 2 via the support ring 33 and the locating ring 34. This produces the desired speed-dependent, axial contact pressure force. In this case the centrifugal body mounting 40*a* to 40*f* or the projection 41*a* to 41*f* acting on the shoulder 42 of the drive shaft 3 serves as the force redirection device. The embodiment represented in FIG. 3 also has the particular advantage of being constructed in an extremely compact manner.

Figure 4:
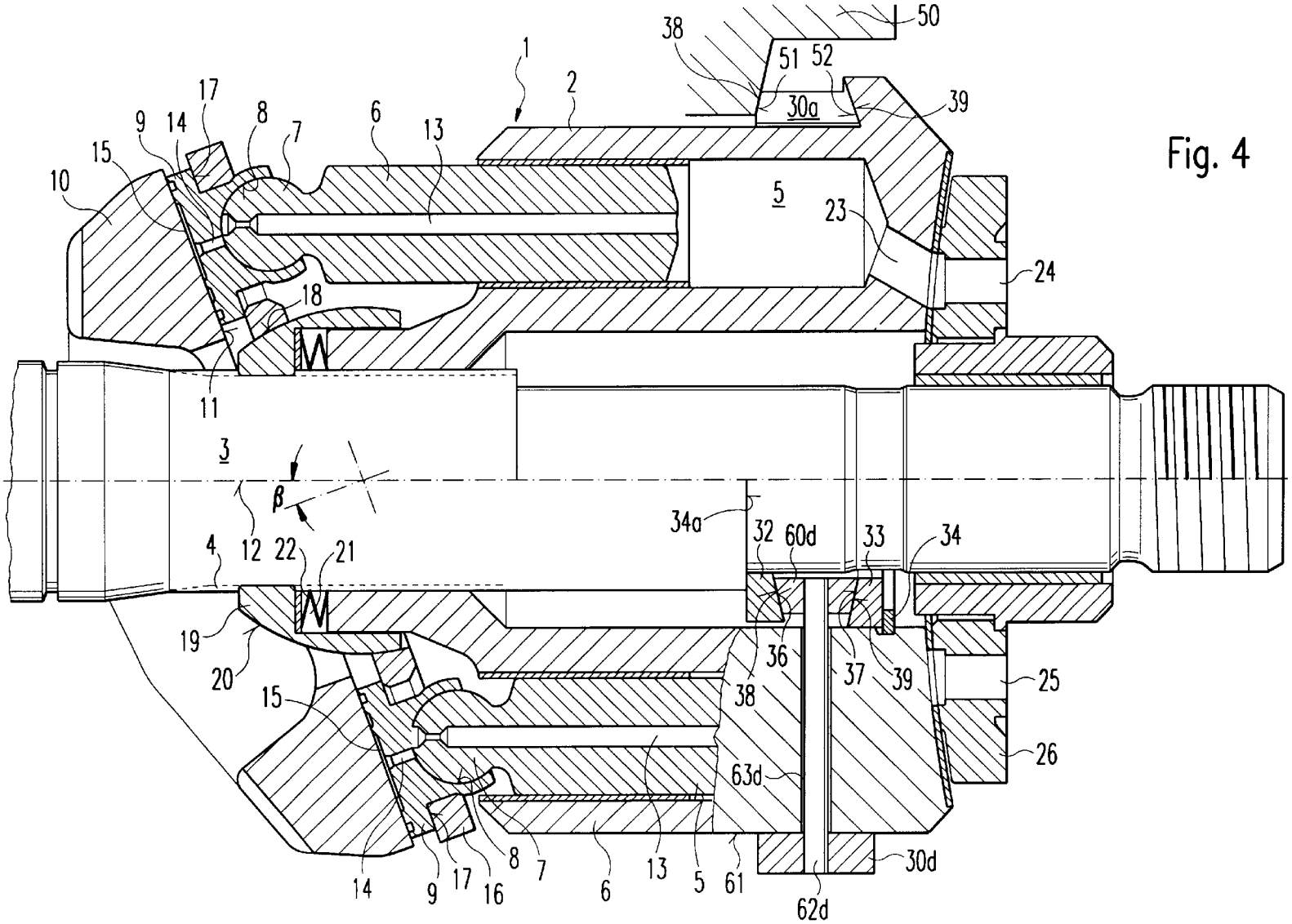
FIG. 4 is an axial section through a third embodiment of an axial piston machine according to the invention.

FIG. 4 is a section through an axial piston machine 1 with a third embodiment and a fourth embodiment of the development according to the invention. Elements which have already been described are given corresponding reference numbers, so that the description need not be repeated.

According to a third embodiment of the invention represented in the upper half of FIG. 4, at least one centrifugal body 30*a*, although preferably a plurality of radially distributed centrifugal bodies 30*a* to 30*f*, is/are supported at the casing 50 of the axial piston machine 1. Here each centrifugal body 30*a* comprises first oblique surfaces 38 and 39 which taper outwards conically in the radial direction. The casing 50 comprises an oblique surface 51 which is adapted to the oblique surface 38 of the centrifugal body 30*a*, while a further oblique surface 52, which is adapted to the oblique surface 39 of the centrifugal body 30*a*, is formed at the cylinder barrel 2. The oblique surfaces 38, 39 and 51, 52 are inclined with respect to the drive shaft axis 12 in accordance with the embodiment already described on the basis of FIG.

1, so that, on account of the wedge effect already described, the centrifugal force acting on the centrifugal body 30*a* is converted into a contact pressure force with an axial force component which presses the cylinder barrel 2 against the control plate 26. The contact pressure force also increases in this embodiment with the square of the speed of the cylinder barrel 2.

The fourth embodiment of the invention represented in the lower half of FIG. 4 differs from the embodiment already described on the basis of FIG. 1 in that instead of the centrifugal bodies 30*a* to 30*f* being directly clamped between the support rings 32 and 33, caulking bodies 60*a* to 60*f*, which are separate from the centrifugal bodies 30*a* to 30*f*, are provided between the support rings 32 and 33. Only the centrifugal body 30*d* and the caulking body 60*d* are represented in FIG. 4. As in the case of the embodiment represented in FIG. 1, the first support ring 32 is supported at the shoulder 34 of the drive shaft 3, while the second support ring 33 is supported via the locating ring 34 at the cylinder barrel 2. Similarly to the centrifugal bodies 30*a* to 30*f* in FIG. 1, the caulking elements 60*a* to 60*f* in FIG. 4 comprise at the end first oblique surfaces 38, 39, which co-operate as already described with second oblique surfaces 36, 37 provided at the support rings 32 and 33. Here the normals to the oblique surfaces 36, 37 and 38, 39 are inclined with respect to the drive shaft axis 12 according to a predetermined angle of inclination. The angle of inclination is preferably between 5° and 25° in this embodiment as well, with an angle of 15° being particularly advantageous.

The centrifugal bodies 30*a* to 30*f* are disposed at the outer circumference 61 of the cylinder barrel 2. As compared with the embodiment represented in FIG. 1, this has the advantage of a greater radial distance between the centrifugal bodies 30*a* to 30*f* and the drive shaft axis 12, so that the centrifugal force F. exerted on the centrifugal bodies 30*a* to 30*f* is correspondingly greater. The centrifugal bodies 30*a* to 30*f* are connected to the caulking elements 60*a* to 60*f* via radial connecting elements 62*a* to 62*f*, only the connecting element 62*d* being represented in FIG. 4. The connecting elements 62*a* to 62*f* may be, e.g. pin-like bolt elements extending in radial bores 63*a* to 63*f* of the cylinder barrel 2, which bores pass through between the cylinder bores 5. The centrifugal bodies 30*a* to 30*f* may also be integrated into or sunk in the cylinder barrel 2. A particularly advantageous feature lies in the centrifugal bodies 30*a* to 30*f* being disposed radially flush with the outer diameter 61 of the cylinder barrel 2, so that the construction space required is not increased by the measure according to the invention.

Figure 5:
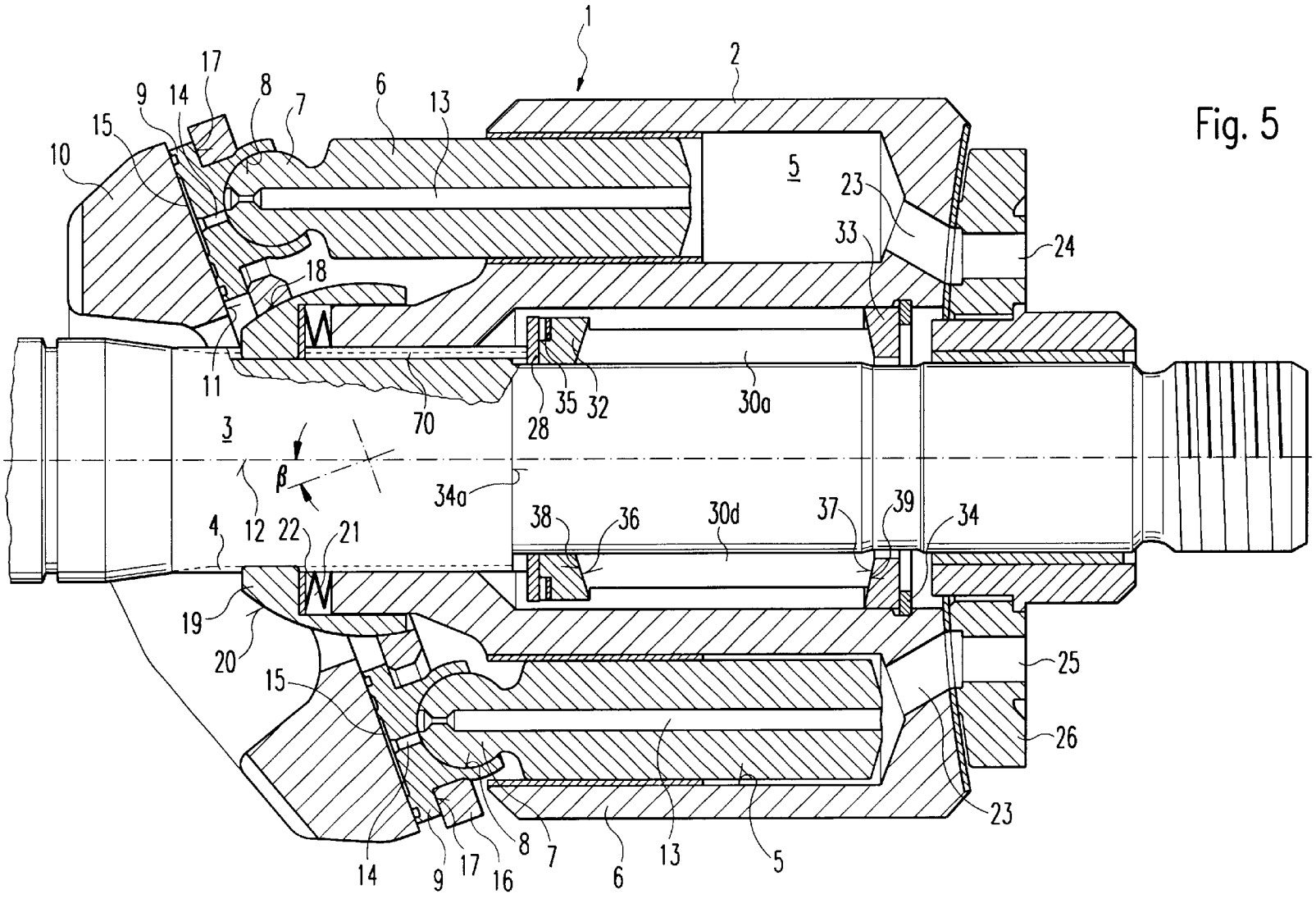
FIG. 5 is a section through a fourth embodiment of an axial piston machine according to the invention.

FIG. 5 is an axial section through an axial piston machine 1 with a fifth embodiment of the development according to the invention. The embodiment corresponds largely to that already described on the basis of FIG. 1. Elements which have already been described are provided with corresponding reference numbers, so that it is unnecessary to repeat the description in this respect.

The embodiment represented in FIG. 5 differs from that represented in FIG. 1 in that the first support ring 32 is not supported via the first locating ring 28 at a shoulder 34 of the drive shaft 3, but rather via a connecting member at the holding-down device 16, 19 consisting of the pull-back plate 16 and the pull-back ball 19. In the embodiment represented in FIG. 1 the connecting member consists of at least one, preferably a plurality of radially distributed connecting pins 70, which are disposed between the support ring 32 or the locating ring 28 and the pull-back ball 19.

By means of the development represented in FIG. 5 it is also possible for the contact pressure force with which the slide shoes 9 are pressed against the slide surface 11 of the oblique plate 10 to increase with the speed of the drive shaft 3 or the cylinder barrel 2. This measure ensures that the slide shoes 9 bear against the slide surface 11 of the oblique plate 10 even when the cylinder barrel 2 is rotating at a high speed and excludes the possibility of the slide shoes 9 lifting off the slide surface 11.

Figure 6:
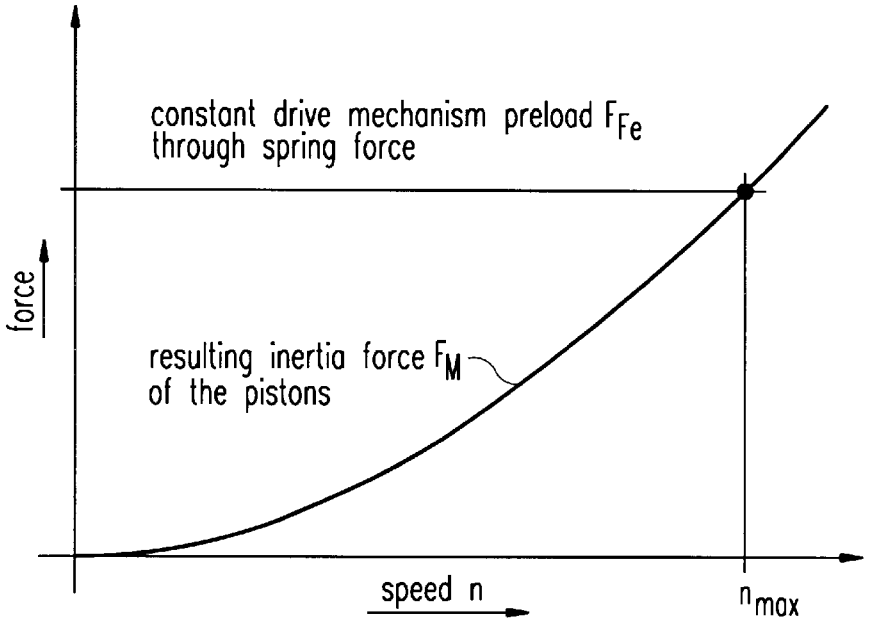
FIG. 6 is a graph for illustrating the inertia force exerted by the pistons and the contact pressure force when employing conventional spring contact pressure and FIG. 7 is a graph for illustrating the contact pressure force in an axial piston machine developed according to the invention.
Figure 7:
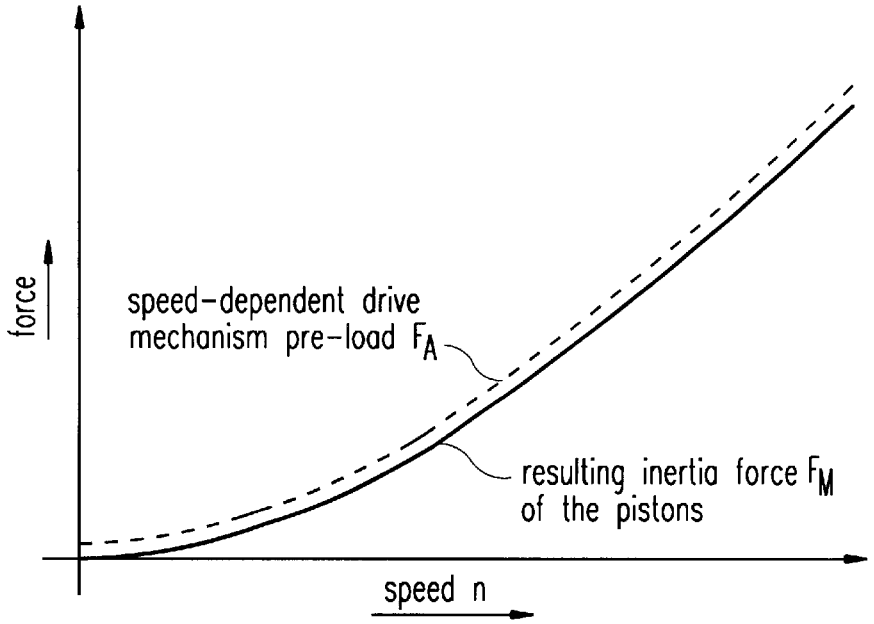

In FIGS. 6 and 7 both the inertia force $F_M$ exerted by the pistons 6 and the contact pressure force $F_A$ or $F_{Fe}$ exerted on the cylinder barrel 2 towards the control plate 26 are represented as a function of the speed in the cylinder barrel 2. In this case FIG. 6 illustrates a conventional formation of the contact pressure device with a contact pressure spring. The contact pressure force or drive mechanism preload $F_{Fe}$ exerted by the contact pressure spring is constant and independent of the speed n. However the inertia force $F_M$ exerted by the pistons 6 on the cylinder barrel 2 increases with the square of the speed n. The maximum speed $n_{max}$ is reached at the latest when the inertia force $F_M$ exerted by the pistons exceeds the constant spring force $F_{Fe}$ exerted by the contact pressure device.

FIG. 7 illustrates by way of comparison the speed-dependent drive mechanism preload $F_A$, which corresponds to the axial component $F_A$ of the contact pressure force, of the contact pressure device according to the invention. As the centrifugal force $F_F$ is also proportional to the square of the speed n of the cylinder barrel 2, the contact pressure force $F_A$ exerted by the contact pressure device according to the invention will always be greater than the inertia force $F_M$ exerted by the pistons 6, given an appropriate design of the contact pressure device according to the invention. The maximum speed $n_{max}$ is not therefore limited by the contact pressure device on account of the system.

The invention is not limited to the represented embodiments. It is in particular possible to combine measures relating to the individual embodiments without taking further steps. The force redirection device may also be formed in various other ways.

What is claimed is:

1. An axial piston machine (1) including a casing (50) a drive shaft (3) mounted in the casing (50) to rotate about a drive shaft axis (12), a cylinder barrel (2) non-rotatably connected to the drive shaft (3) wherein a plurality of cylinders (5) are formed to accommodate a plurality of axially mobile pistons (6), a control plate (26) with control ports (24, 25) for cyclically connecting the cylinders (5) to a high-pressure and a low-pressure line, and a contact pressure device for preloading the cylinder barrel (2) against the control plate (26), wherein the contact pressure device comprises at least one centrifugal body (30*a*–30*f*) which is translated outwardly when subjected to an increasing centrifugal force ($F_F$) as the speed (n) of the cylinder barrel (2) increases, wherein at least one force redirection member (36–39; 40*a*–40*f*, 41*a*–41*f*) is provided to convert the centrifugal force ($F_F$) acting on the centrifugal body (30*a*–30*f*) into a contact pressure force which is applied to the cylinder barrel (2) and the contact pressure force has a component ($F_A$) which is applied to the cylinder barrel (2) in an axial direction to the drive shaft axis (12), and the force redirection member (36–39) is disposed in a cavity (31) between the cylinder barrel (2) and the drive shaft (3).

2. An axial piston machine according to claim 1, wherein said force redirection members (36–39) are supported in said cavity (31) between the drive shaft (3) and the cylinder barrel (2).

3. An axial piston machine (1) having a casing (50), a drive shaft (3) mounted in the casing (50) to rotate about a drive shaft axis (12), a cylinder barrel (2) non-rotatably connected to the drive shaft (3) wherein a plurality of cylinders (5) are formed to accommodate a plurality of axially mobile pistons (6), a control plate (26) with control ports (24, 25) for cyclically connecting the cylinders (5) to a high-pressure and a low-pressure line, a contact pressure device for preloading the cylinder barrel (2) against the control plate (26), wherein the contact pressure device comprises at least one centrifugal body (30*a*–30*f*) which is translated outwardly when subjected to an increasing centrifugal force ($F_F$) as the speed (n) of the cylinder barrel (2) increases, wherein at least one force redirection member (36–39; 40*a*–40*f*, 41*a*–41*f*) is provided to convert the centrifugal force ($F_F$) acting on the centrifugal body (30*a*–30*f*) into a contact pressure force which is applied to the cylinder barrel (2) and has a component ($F_A$) which is applied to the control plate (26) in an axial direction to the drive shaft axis (12), and the force redirection member (37, 38, 51, 52) is supported by the casing (50) and the cylinder barrel (2).

4. An axial piston machine according to claim 1 or 3, wherein each force redirection member (37–39) comprises at least one oblique surface (38, 39) provided at the centrifugal body (30*a*–30*f*) or a caulking element (60*a*–60*f*) connected to the centrifugal body (30*a*–30*f*), and wherein a normal thereto forms an incline with the drive shaft axis (12) at a predetermined angle of inclination ($\alpha$).

5. An axial piston machine according to claim 4, wherein each force redirection member (37–39) comprises at least one oblique surface (36, 37) provided at a counterpart (32, 33) operatively connected to the centrifugal body (30*a*–30*f*) or the caulking element (60*a*–60*f*), and the normal thereto forms an incline with the drive shaft axis (12) at a predetermined angle of inclination ($\alpha$).

6. An axial piston machine according to claim 4, wherein the angle of inclination ($\alpha$) formed by the normal to the oblique surface with the drive shaft axis (12) lies within the range of between 5° and 25°.

7. An axial piston machine according to claim 4, wherein each said caulking element (60*a*–60*f*) is disposed in a cavity (31) between the cylinder barrel (2) and the drive shaft (3) and is connected to at least one associated centrifugal body (30*a*–30*f*) via a radial connecting element (62a–62*f*).

8. An axial piston machine according to claim 5, wherein the counterpart (32, 33) is formed by a first support ring (32) supported at the drive shaft (3), and a second support ring (33) supported at the cylinder barrel (2).

9. An axial piston machine according to claim 8, wherein a spring element (35) preloads at least one ring (32) of the support rings (32, 33) is preloaded against the centrifugal body (30*a*–30*f*) or against the caulking element (60*a*–60*f*).

10. An axial piston machine according to claim 1, wherein at least one of the centrifugal bodies (30*a*–30*f*) is mounted on one side at the cylinder barrel (2) in a centrifugal body mounting (40*a*–40*f*), and a projection (41*a*–41*f*) of the centrifugal body (30*a*–30*f*) is applied to a shoulder (42) of the drive shaft (3) such that the axial component ($F_A$) of the contact pressure force is exerted on the centrifugal body mounting (40*a*–40*f*) operating as a force redirection device, responsive to the centrifugal force ($F_F$) acting on the centrifugal body (30*a*–30*f*) during outward translation.

11. An axial piston machine according to claim 1, wherein at least one of the centrifugal bodies (30*a*–30*f*) is mounted on one side at the drive shaft (3) in a centrifugal body mounting, and a projection of the centrifugal body is applied to a shoulder of the cylinder barrel causing exerting of the axial component ($F_A$) of the contact pressure force on the shoulder operating as a force redirection member of the cylinder barrel (2) responsive to the centrifugal force ($F_F$) acting on the centrifugal body (30*a*–30*f*) during outward translation.

12. An axial piston machine according to claim 1, wherein the plurality of pistons (6) are supported via slide shoes (9) at an oblique plate (10), a holding-down appliance (16, 19) causing the slide shoes (9) to bear against the oblique plate (11), and the axial component ($F_A$) of the contact pressure force additionally acts on the holding-down appliance (16, 19).

13. An axial piston machine according to claim 12, wherein the holding-down appliance (16, 19) comprises a pull-back plate (16) bearing against the slide shoes (9), and a pull-back ball (19) bearing against the pull-back plate (16) in every pivoted position of the oblique plate (10), and wherein the axial component ($F_A$) ofthe contact pressure force is applied to the holding-down appliance (16, 19) via a connecting member (70) disposed between the force redirection member (36–39; 40*a* to 40*f*, 41*a*–41*f*) and the pull-back ball (19).

14. An axial piston machine according to claim 13, wherein each connecting member consists of at least one connecting pin (70) which is disposed parallel-axially with the drive shaft axis (12) between one of the support rings (32) and the pull-back ball (19).

* * * * *